US005401096A

United States Patent [19]

Stang

[11] Patent Number: 5,401,096

[45] Date of Patent: Mar. 28, 1995

[54] SPRING-CONTROLLED SUPPORT ARM FOR A DESK TOP

[75] Inventor: Emil Stang, Westfield, Mass.

[73] Assignee: Columbia Manufacturing Company, Inc., Westfield, Mass.

[21] Appl. No.: 62,844

[22] Filed: May 17, 1993

[51] Int. Cl.[6] ..... A47B 95/00

[52] U.S. Cl. ..... 312/319.2; 49/386; 16/293; 16/291; 16/305; 74/97.1

[58] Field of Search ..... 312/319.2, 319.1, 235.9, 312/328; 49/386; 16/293, 291, 286, 304, 305; 74/97.1

[56] References Cited

U.S. PATENT DOCUMENTS

| | | | |
|---|---|---|---|
| 829,385 | 8/1906 | Brennan | 16/291 |
| 887,834 | 5/1908 | Nelson | 49/386 |
| 1,411,660 | 4/1922 | Howson | 312/194 |
| 2,259,970 | 10/1941 | Benzick | 16/291 |
| 2,903,149 | 9/1959 | Turner | 16/291 |
| 3,561,162 | 2/1971 | Goldman | 49/386 |
| 3,583,014 | 6/1971 | Brown et al. | 49/386 |
| 4,124,296 | 11/1978 | Kishi et al. | 16/306 |
| 4,899,420 | 2/1990 | Bye et al. | 16/306 |

*Primary Examiner*—Laurie K. Cranmer
*Assistant Examiner*—Janet M. Wilkens
*Attorney, Agent, or Firm*—Chapin, Neal & Dempsey

[57] ABSTRACT

A desk having a desk top that is movable with respect to a storage compartment under application of an external force through an open position, an intermediate position, and a closed position. A support member is provided to support the desk top as it moves through these positions. In particular, the support member is adapted so that upon the removal of the external force if the desk top is positioned between the intermediate and closed positions, the desk top will slowly move to its closed position.

12 Claims, 3 Drawing Sheets

SPRING-CONTROLLED SUPPORT ARM FOR A DESK TOP

FIELD OF THE INVENTION

The present invention relates generally to desks and more particularly, to a mechanism for assisting in the opening and closing of a desk top.

BACKGROUND OF THE INVENTION

Desks have been a commonplace item in schools for many years. One type of desk consists of a hard writing surface that is hingedly connected to a frame having a compartment designed to store books, paper or other school materials. Desks of this type are commonly used for kindergarten or elementary school children of young age and are useful in that a student can store his/her school materials thereby eliminating the need for an independent storage unit such as a school locker.

Desks of this type, however, are not without their drawbacks. One drawback is that young children are acutely susceptible to getting their fingers accidently caught between the desk top and the storage compartment when the desk top is closed. Further, young children are likely to "drop" the desk top rather than gently lowering the desk top onto the storage compartment thereby generating a loud noise which is often disturbing to other students and/or teachers.

SUMMARY OF THE INVENTION

One object of the present invention was to develop a storage type school desk that could be safely used by young children.

Another object of the present invention was to develop a storage type desk that was inexpensive to manufacture thereby providing an affordable yet safe desk for school systems facing declining budgets.

The present invention generally consists of a desk top that is hingedly connected to a storage compartment capable of storing school related items, and a spring-controlled support arm that safely supports the desk top as it is opened or closed. In one embodiment, the support arm employs a spring that is designed to always urge the desk top upward to an open position where the storage compartment is accessible by the children. Without the application of a downward external force, the desk top cannot be lowered. When an external force is applied so as to lower the desk top to a predetermined intermediate position within a few inches of the storage compartment, the downward force resulting from the weight and relative angle of the desk top will exceed the upward force supplied by the spring thereby causing the desk top to slowly close.

BRIEF DESCRIPTION OF THE DRAWINGS

The following detailed description will become better understood with reference to the accompanying drawings in which.

DETAILED DESCRIPTION OF THE PREFERRED EMBODIMENTS

Figure 1:
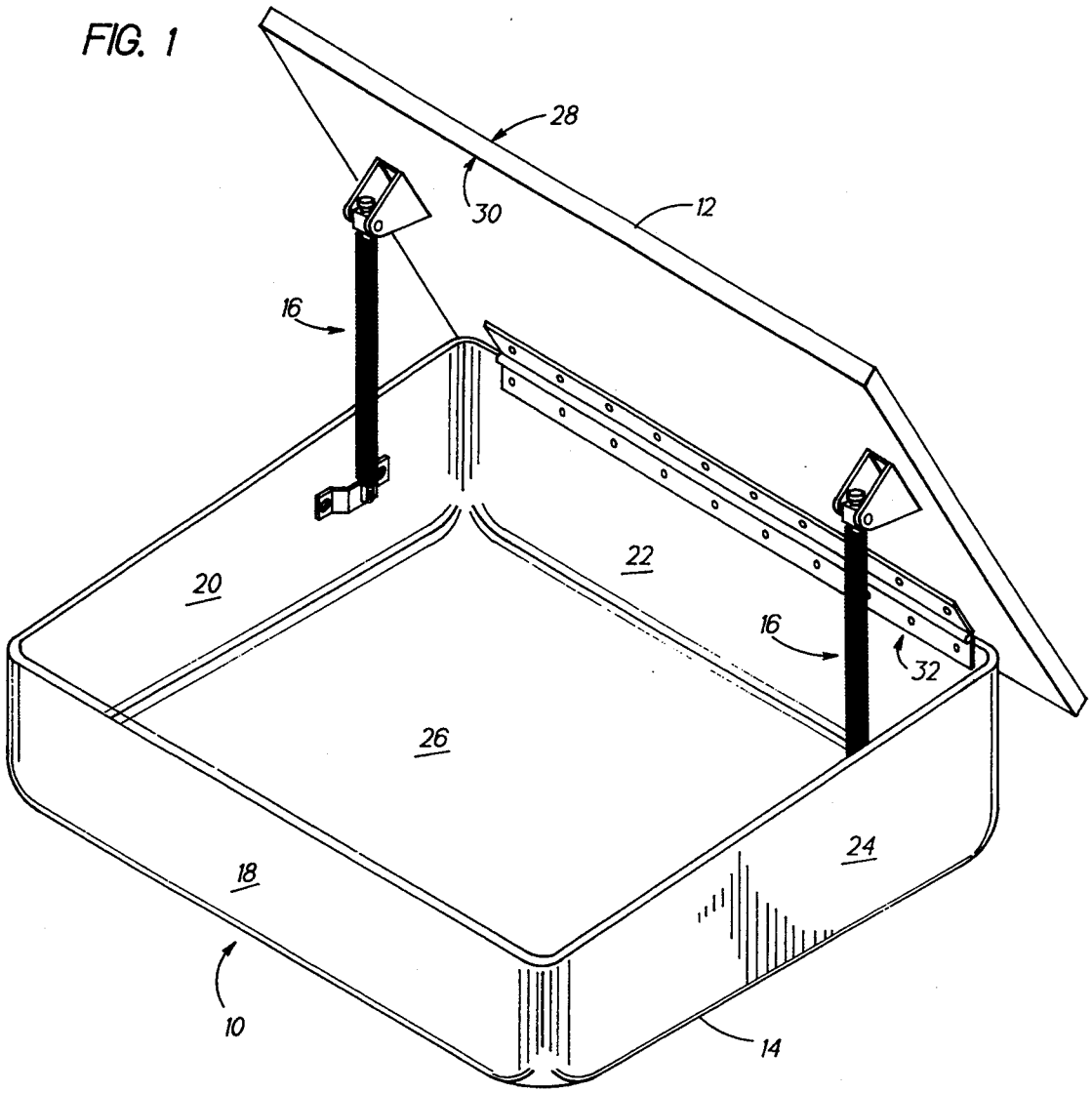
FIG. 1 (a perspective view of the present invention showing a storage type desk and a spring-controlled support arm mounted therein.

Referring to FIG. 1, the desk 10 of the present invention generally comprises a desk top 12 that is hingedly connected to a storage compartment 14, and a pair of spring-controlled support arms 16 which safely support the desk top 12 in a fully open position and/or while it is being lowered to a closed position. As will be described more fully herein, the support arms 16 are designed to always urge the desk top 12 upward toward an open position, thereby preventing the desk top 12 from accidently "tumbling" onto the storage compartment 14 and injuring a student and/or generating a loud disrupting noise.

The storage compartment 14 is formed by side walls 18, 20, 22, 24 and a floor 26. The storage compartment 14 may be made from a variety of materials and can be fabricated by a variety of methods. In the preferred embodiment, storage compartment 14 is made of sheet metal and formed by well known metal forming and welding operations.

The desk top 12 is of generally flat and rectangular design and comprises a substantially planar and relatively hard outside surface 28 suitable for writing and/or other school related activities. Desk top 12 has a bottom surface 30 having one end hingedly connected to the inside surface of side wall 22 of the storage compartment 14 by a conventional double-leaf hinge 32.

Figure 2:
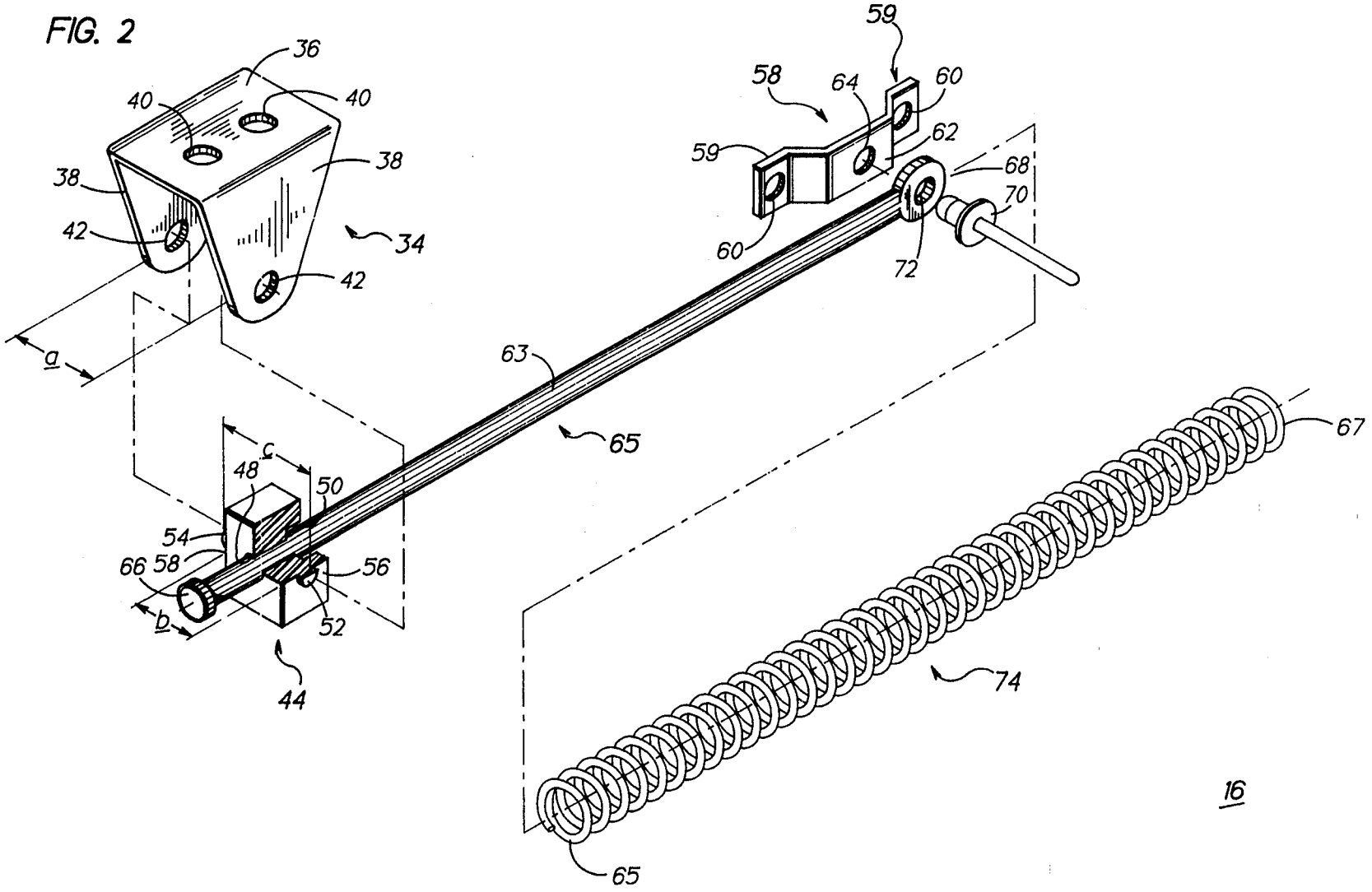
FIG. 2 is an exploded perspective view showing various features of the spring-controlled support arm.

Referring to FIG. 2, Where one of the support arms 16 is shown in more detail. Support arm 16 comprises a jaw bracket 34 having a base 36 and a pair of protruding and generally parallel spaced side flanges 38 separated by a distance a. Base 36 includes a plurality of openings 40 adapted to mount the bracket 34 to the bottom surface 30 of desk top 12 by conventional fastening means. Side flanges 38 each have an opening 42 which are in axial alignment with each other. The spacing a between side flanges 38, the diameter of openings 42, and the height of the openings 42 relative to the base 36 are such that a retainer 44 can freely rotate therein.

Retainer 44 comprises an opening or thru-hole 48 having a diameter sized to allow Retainer 44 to slide along a guide arm 65 (to be described). Opening 48 is provided with a counter-bore opening or recess 50 sized to receive an end 69 of a spring 74 (to be described). Retainer 44 further comprises protrusions 52 and 54 extending outward from sides 56 and 58, respectively. The overall distance b between the protrusions 52 and 54 and the overall distance c between sides 56 and 58 relative to distance a is such that the retainer 44 can securely rotate between side flanges 38 about openings 42. Retainer 44 is preferably made from a plastic material and may be formed by a variety of well known fabrication techniques.

Guide arm 65 is generally provided to support and define the range of movement of retainer 44 and thus the relative opening and closing of desk top 12. Guide arm 65 generally comprises a medial portion 63 which in the preferred embodiment is of cylindrical shape. The outside diameter of medial portion 63 is such that opening 48 of retainer 44 can easily slide thereon. One end of guide arm 65 is formed with a head or flange 66 which has a diameter larger than that of opening 48 to thereby provide a maximum range of axial movement of retainer 44 with respect to bracket 58. The other end of guide arm 65 is formed with a fiat end 68 having an opening 72 adapted to be rotatably fastened to opening 64 of bracket 58 by conventional fastening means such as a rivet 70. It should be noted that flat end 68 is initially of cylindrical shape and is flattened after the spring 74 is assembled onto guide arm 65.

The support arm 16 further comprises a bracket 58 having a base 59 that is conventionally fastened to the inside of surface of side wall 20 by openings 60. Bracket 58 is also formed with an outwardly displaced surface 62 having an opening 64 suitably designed to rotatably support one end 68 of a guide arm 65. Surface 62 is outwardly displaced a distance from base 59 so that the guide arm 65 will not interfere with side wall 20 as the desk top 12 is opened and closed.

Spring 74 comprises a first end 69 securely retained within the counter-bore 50 of retainer 44 and a second end 67 secured in position against flat end 68 of guide arm 65. The length, thickness, diameter and/or number of coils of spring 74 is chosen such that the spring 74 will exert a force upon retainer 44 and thus desk top 12, which is large enough to support the desk top 12, will be in its fully open position. This necessarily means that spring 74 would have to be "pre-loaded" in compression when assembled onto guide arm 65. In addition, the angular position of the guide arm 65, defined by the position of bracket 58 on side wall 20 and the height of the openings 42 relative to the lower surface 30 of the desk top 12, is such that when the desk top 12 is moved to its closed position, the spring 74 is still applying a resultant upward force upon the retainer 44 and thus the desk top 12. The upward spring force, although not large enough to prevent the desk top 12 from completely closing, is large enough so as to eliminate the possibility of the desk top 12 "snapping closed" as the desk top 12 is lowered. In the preferred embodiment, the spring 74 is an open helical compression spring.

Figure 3:
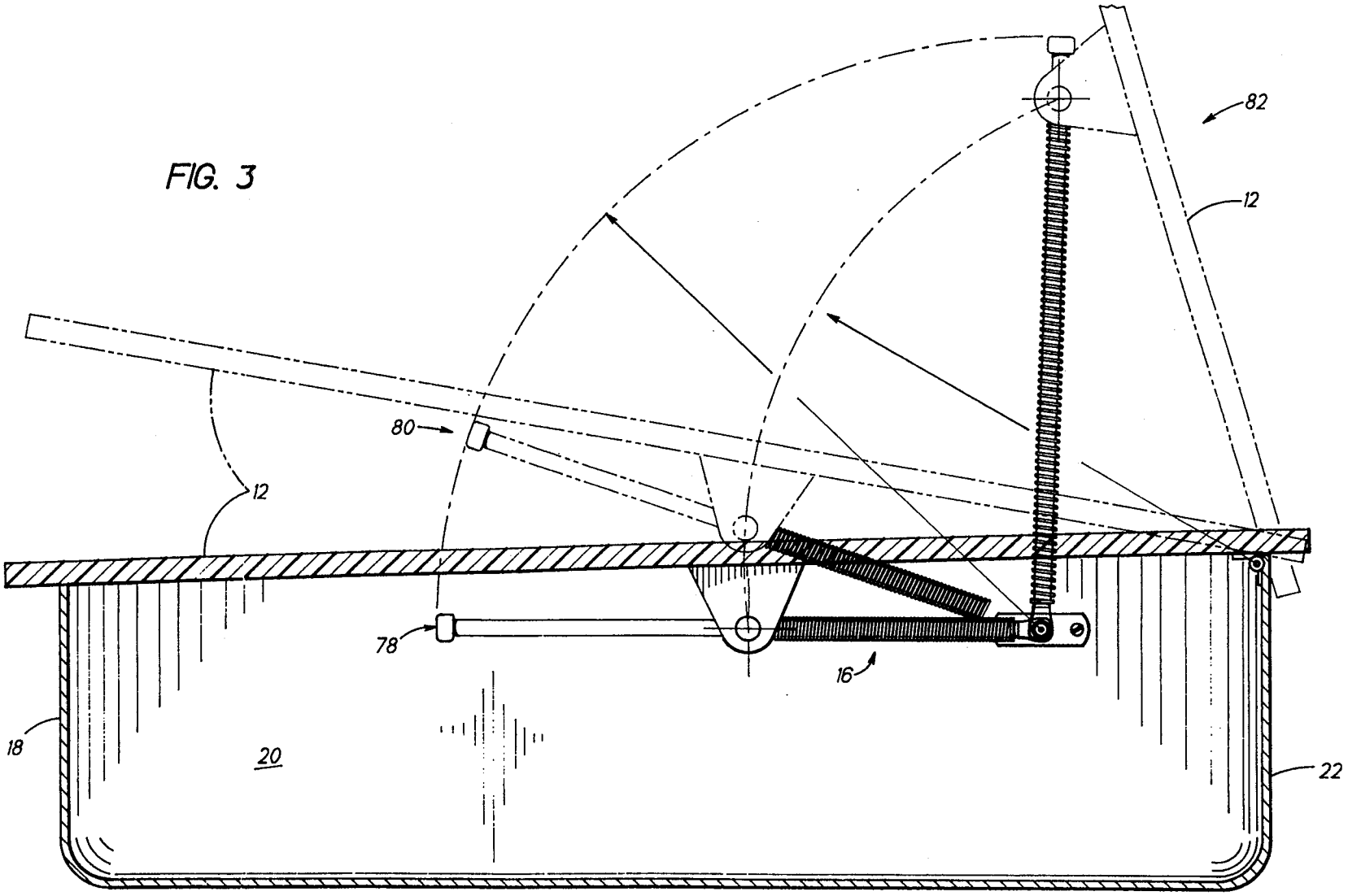
FIG. 3 is a cross-sectional view showing the desk top and spring-controlled position in a closed position, an intermediate position, and a fully open position.

FIG. 3 shows the support arm 16 and desk top 12 in three positions: (1) fully open position 82; (2) an intermediate position 80; and (3) a closed position 78. When desk top 12 is in the fully open position 82, the spring 74 exerts a force which maintains the retainer 44/bracket 34 combination adjacent to the flange end 66 of guide arm 65. The stiffness of spring 74 is chosen such that the desk top 12 will not close without an application of an external force.

When the desk top 12 is lowered by application of an external force, the retainer 44 will move along the medial portion 63 of guide arm 65, thereby causing the spring 74 to become further compressed. If the desk top 12 is lowered to a position between the open position 82 and the intermediate position 80, removal of the external force will result in the top remaining in that position or the return of desk top 12 to its fully open position 82. This feature, for example, prevents the accidental closing of the desk top 12 which might occur should a student inadvertently "bump" into the desk top.

When the desk top 12 is lowered to the intermediate position 80, the force resulting from the weight and angular position of the desk top 12 will exceed the upward force applied by spring 74 at which point, the desk top 12 will slowly move to its closed position 78 without the application of any additional external force. It should be noted that because the spring 74 always applies an upward force, the desk top 12 will close slowly rather than "snapping" closed which would occur if the spring 74 were adapted to apply a downward force after movement of the desk top 12 through the intermediate position 80.

The foregoing description has been for illustrative purposes only. As will be obvious to one skilled in the art, the present invention may be readily modified without departing from the spirit and scope of the invention as defined by the following claims.

What is claimed:

1. A desk comprising a desk top that is movable with respect to a storage compartment under application of an external force through an open position, an intermediate position, and a closed position; a support member having a spring which exerts an upward force on said desk top throughout the range of movement thereof, said support member adapted to support said desk top so that upon removal of said external force if said desk top is positioned between said intermediate and said closed positions, said desk top will slowly move to said closed position and if said desk top is positioned between said open position and said intermediate position, said desk top will remain stationary or return to said open position.

2. The desk of claim 1, wherein said support member further comprises a retainer being slidable along a guide arm and movably fastened to said desk top.

3. The desk of claim 2, wherein said guide arm comprises a first end, a medial portion and a second end, said first end being movably fastened to said storage compartment, said retainer being slidable along said medial portion of said guide arm and said spring disposed between said retainer and said first end of said guide arm.

4. The desk of claim 3, wherein said retainer comprises an opening adapted to slidably receive said medial portion of said guide arm.

5. The desk of claim 4, wherein said retainer is connected to said desk by a bracket.

6. The desk of claim 5, wherein said retainer is rotatably mounted within said bracket.

7. The desk of claim 5, wherein said bracket comprises a pair of flanges extending from said desk top, each of said flanges having an opening therein.

8. The desk of claim 7, wherein said retainer comprises a pair of protrusion adapted to be rotatably fastened with said openings of said bracket.

9. The desk of claim 4, wherein said opening of said retainer is circular.

10. The desk of claim 3, wherein said guide arm is a cylindrical rod.

11. The desk of claim 3, wherein said spring is a helical spring.

12. The desk of claim 3, wherein said retainer is of unitary construction.

* * * * *